US005078273A

United States Patent [19]

Kuchenbecker

[11] Patent Number: 5,078,273

[45] Date of Patent: Jan. 7, 1992

[54] MICROWAVE CARTON AND BLANK FOR FORMING THE SAME

[75] Inventor: Morris W. Kuchenbecker, Neenah, Wis.

[73] Assignee: James River Corporation of Virginia, Richmond, Va.

[21] Appl. No.: 653,949

[22] Filed: Feb. 12, 1991

[51] Int. Cl.[5] ..... B65D 5/54

[52] U.S. Cl. ..... 229/207; 493/63; 229/3.1; 229/237; 229/243; 229/245; 229/924

[58] Field of Search ..... 493/56, 63, 363, 364; 206/607, 611, 612, 625, 628; 229/902, 903, 906

[56] References Cited

U.S. PATENT DOCUMENTS

| | | | |
|---|---|---|---|
| 3,167,238 | 1/1965 | Smith | 206/625 |
| 3,399,820 | 9/1968 | Foster et al. . | |
| 3,526,353 | 9/1970 | Jaeschke | 206/607 |
| 3,572,576 | 3/1971 | Foster | 206/625 |
| 3,580,466 | 5/1971 | Thelen | 206/607 |
| 3,905,646 | 9/1975 | Brackmann et al. | 206/625 |
| 4,043,503 | 8/1977 | Meyers et al. | 206/625 |
| 4,594,492 | 6/1986 | Maroszek . | |
| 4,613,046 | 9/1986 | Kuchenbecker . | |
| 4,687,104 | 8/1987 | Ielmini . | |
| 4,738,365 | 4/1988 | Prater | 206/625 |
| 4,813,594 | 3/1989 | Brown et al. | 229/906 |
| 4,886,170 | 12/1989 | Willey et al. . | |
| 4,919,785 | 4/1990 | Willey et al. . | |
| 4,930,639 | 6/1990 | Rigby | 206/625 |

*Primary Examiner*—Gary E. Elkins

*Attorney, Agent, or Firm*—Sixbey, Friedman, Leedom & Ferguson

[57] ABSTRACT

A carton and blank for forming the same are disclosed and includes a bottom panel, a top panel, side walls extending substantially perpendicularly away from the bottom panel toward the top panel with the side walls being connected to the bottom panel about a periphery thereof, and overlapping side walls extending substantially perpendicularly away from the top panel toward the bottom panel from predetermined peripheral edges of the top panel. An opening device is formed in the top panel for permitting access to an interior of the carton with the opening device including an opening force receiving mechanism in the form of a lifting tab is integrally formed in one of the overlapping side walls of the top panel for providing an initiation point for the opening device. Initial regions of weakness formed in the top panel extending from the lifting tab to respective peripheral edges of the top panel and continued regions of weakness are provided which extend from the initial regions of weakness substantially parallel to and including the respective peripheral edges of the top panel and extend toward a peripheral edge of the top panel which opposes the lifting tab wherein as previously mentioned, the continued regions of weakness include an inner partially cut score line of weakness and an outer perforated through cut line of weakness with the inner and outer lines of weakness extending substantialy parallel to one another such that a ply-separation occurs in the region between the respective lines of weakness when an opening force is applied to the lifting tab by the consumer. A device for facilitating the manipulation of the lifting tab is also disclosed.

31 Claims, 3 Drawing Sheets

MICROWAVE CARTON AND BLANK FOR FORMING THE SAME

BACKGROUND OF THE INVENTION

1 Technical Field

The present invention relates to a carton blank and a carton which is to be filled with a consumable product accessible through an opening in the carton. More particularly, the invention pertains to an opening feature formed in a top panel of a microwavable carton which provides a reliable and consistent opening when opened by the consumer.

2. Background Art

Paperboard cartons have been manufactured with a variety of opening features which allow the consumer access to the contents of the cartons and which are microwavable in nature. These opening features may consist of perforations, herringbone cuts, adhesive weaknesses, as well as other means for providing a point along the top panel, side panel or hinge lines where the carton may be most readily opened. A further opening feature commonly employed in cartons of this type is that of double-cut scores, as shown in U.S. Pat. No. 3,399,820 issued to Foster et al.

The above mentioned opening feature is formed by way of double-cut scores, i.e. an inner and outer cut in the paperboard which extend approximately half way through the paperboard thickness and which runs substantially parallel to one another. By so providing these cut score lines, when the consumer applies an upward force or opening force on the pull tab provided between the pairs of cut score lines, a ply-separation occurs in the regions between the inner and outer cut score lines. Continued pulling of the pull tabs causes complete separation of the opening flap to allow the consumer unobstructed access to the contents of the container.

Similar opening features are disclosed in U.S. Pat. No. 4,746,109 issued to Prater and U.S. Pat. No. 4,613,046 issued to Kuckenbecker. As in the above-mentioned patent, a point of weakness is provided in a panel of a respective carton where a ply-separation of the panel is permitted to occur when the consumer applies an opening force to the pull tab. The ply-separation occurs between the two pairs of reverse cut score lines which are formed approximately half way through the panel of the carton. However, when forming the paperboard blanks which are to be later used in erecting the cartons disclosed, it is extremely difficult to accurately achieve the desired extent of the cut lines of both the top and bottom cut. These paperboard blanks are formed in a matrix which consist of a plurality of forming dies and counters. Because the paperboard material must be cut partially through both sides of the top panel in substantial alignment with one another to form the double or reverse cuts, an extensive alignment procedure must be undertaken to assure that each cut formed in each side of the paperboard blank of the matrix is properly formed.

U.S. Pat. No. 4,687,104 issued to Ielmini discloses a similar carton and carton blank having score lines formed in the outer and inner surfaces of the top and front flap. These score lines are referred to as extending partially through the outer and inner surfaces of the carton and carton blank, this being essentially identical to that disclosed in the above mentioned patents. Additionally, with the patent to Ielmini as well as those previously discussed, during the sealing of the front flap to the underlying side wall, often the pull tab of the lift tab of the front flap becomes inadvertently adhered to the underlying panel and consequently requires extensive effort on the part of the consumer to initiate the opening of the container.

Similarly, U.S. Pat. No. 4,594,492 issued to Maroszek discloses a carton having an opening feature formed in the top panel thereof and extending into the front flap forming a lift tab which includes a pull tab. Again the opening feature is defined by a pair of substantially parallel inner and outer partially cut lines of weakness, thus exhibiting a ply-separation therebetween during the application of an opening force by the consumer. In order to aid in the ply-separation, the outer line of weakness is formed substantially co-linear with the respective fold lines between the top panel and the side panels of the carton. In doing so, stress concentrations may be readily formed along this line of weakness. Also as with the previously discussed prior art references, during the sealing of the front flap to the underlying sidewall, the pull tab of the lift tab which is integrally formed within the front flap may be inadvertently adhered to the underlying panel resulting in a significant effort being required by the consumer to lift the lift tab and subsequently open the carton. It should be noted that by providing a partially cut score line of weakness substantially co-linear with the fold line between the top panel and side panels thereof, may result in these edges being easily worn in that the outer coating of the paperboard material will be severed along substantially the entire length of the fold line. Such may result in an unsightly appearance of the container after a minimal amount of handling.

In an effort to overcome the above-mentioned shortcomings associated with the prior art, U.S. Pat. No. 4,886,170 and No. 4,919,785 issued to Wiley et al. disclose cartons similar to those discussed above. The opening feature of Wiley et al. includes inner and outer partially cut score lines as with the previous references however, the portion of the outer cut score line which extends substantially co-linear with the fold line between the top panel and the side panel is formed in a non-continuous manner thereby leaving a portion of the outer surface of the paperboard material intact about the respective fold lines. However, as with the previous references, the formation of partially cut score inner and outer lines of weakness in the paperboard material is difficult to control and with a portion of the inner and outer cut score line of weakness being formed in a non-continuous manner only adds to the difficulty in forming such lines of weakness. In addition to the foregoing, as previously discussed, during the sealing of the carton, the pull tab extension of the lift tab integrally formed in the front flap may be inadvertently sealed to the underlying panel. If such is the case, a ply-separation may occur in undesirable regions of the front flap during the application of an opening force to the lift tab by the consumer.

As can be seen from the foregoing, there is clearly a pressing need for a carton of the above-mentioned type which will provide a reliable and easy opening feature that is capable of being opened with ease by the consumer, and which may be readily and reliably formed during the manufacture of the paperboard blanks.

SUMMARY OF THE INVENTION

It is an object of the present invention to overcome the deficiencies of the prior art. In particular, it is an object of the present invention to provide a carton having a reliable opening feature which is capable of opening smoothly without retarding the structural integrity of the carton.

It is another object of the present invention to provide a paperboard blank for forming a carton having an opening feature wherein the cut score lines forming the regions of weakness may be readily controlled during the manufacture of the paperboard blank.

Yet another object of the present invention is to provide a carton in which the consumer may freeze and heat or cook the contents of the carton while in the carton. The consumer is then capable of readily gaining access to the contents of the carton without destroying the structural integrity of the container.

An additional object of the present invention is to provide a reliable opening feature which may be readily formed during the manufacture of the paperboard blanks for forming the carton and which will resist deterioration of the paperboard material during handling by processing equipment or the consumer.

Yet another object of the present invention is to provide a means for preventing a pull tab portion of a lift tab integrally formed in a front flap of the carton from adhering to the underlying panel thereof during the sealing of the carton.

These as well as various additional objects and advantages of the subject invention are achieved by providing a paperboard carton blank including a first panel having side walls connected thereto by scored fold lines formed between a respective one of the side walls and a respective edge of the first panel and a second panel having side walls connected thereto by scored fold lines formed between a respective side wall and an edge of the second panel with one of the side walls of the first panel one of the side walls of the second panel being congruent. An opening device is formed in the second panel for permitting access to an interior of a carton formed from the blank with the opening device including an opening force receiving mechanism in the form of a lifting tab integrally formed in one of the side walls of the second panel for providing an initiation point for the opening device. Initial regions of weakness are formed in the second panel extending from the lifting tab toward respective peripheral edges of the second panel, and continued regions of weakness extending from the initial regions of weakness substantially parallel to and including respective peripheral edges of the second panel to an edge of the second panel opposing the lifting tab is also provided wherein the continued regions of weakness include an inner partially cut score line of weakness and an outer perforated through cut line of weakness with the inner and outer lines of weakness extending substantially parallel to one another such that a ply-separation occurs in the region between the respective lines of weakness when an opening force is applied to the lifting tab by the consumer.

This carton blank is then used to form a carton for containing a product placed therein. The carton includes a bottom panel, a top panel, side walls extending substantially perpendicularly away from the bottom panel toward the top panel with the side walls being connected to the bottom panel about a periphery thereof, and overlapping side walls extending substantially perpendicularly away from the top panel toward the bottom panel from predetermined peripheral edges of the top panel. An opening device is formed in the top panel for permitting access to an interior of the carton with the opening device including an opening force receiving mechanism in the form of a lifting tab is integrally formed in one of the overlapping side walls of the top panel for providing an initiation point for the opening device. Initial regions of weakness formed in the top panel extending from the lifting tab to respective peripheral edges of the top panel and continued regions of weakness are provided which extend from the initial regions of weakness substantially parallel to and including the respective peripheral edges of the top panel and extend toward a peripheral edge of the top panel which opposes the lifting tab wherein as previously mentioned, the continued regions of weakness include an inner partially cut score line of weakness and an outer perforated through cut line of weakness with the inner and outer lines of weakness extending substantially parallel to one another such that a ply-separation occurs in the region between the respective lines of weakness when an opening force is applied to the lifting tab by the consumer.

In addition to the forgoing, a device for facilitating the manipulation of the lifting tab of the above described paperboard carton is set forth and includes at least one crease score line formed in a surface of the lifting tab and an embossed line formed in a surface of a panel of the carton which underlies the lifting tab such that the embossed line is positioned so as to underlie at least a portion of the crease score line such that a portion of the embossed line contacts that portion of the crease score line thereby preventing the sealing of a portion of the lifting tab to the underlying panel.

Additional advantages of the subject invention will become apparent from the figures and the following detailed description of the preferred embodiment.

DETAILED DESCRIPTION OF THE PREFERRED EMBODIMENT

Figure 1:
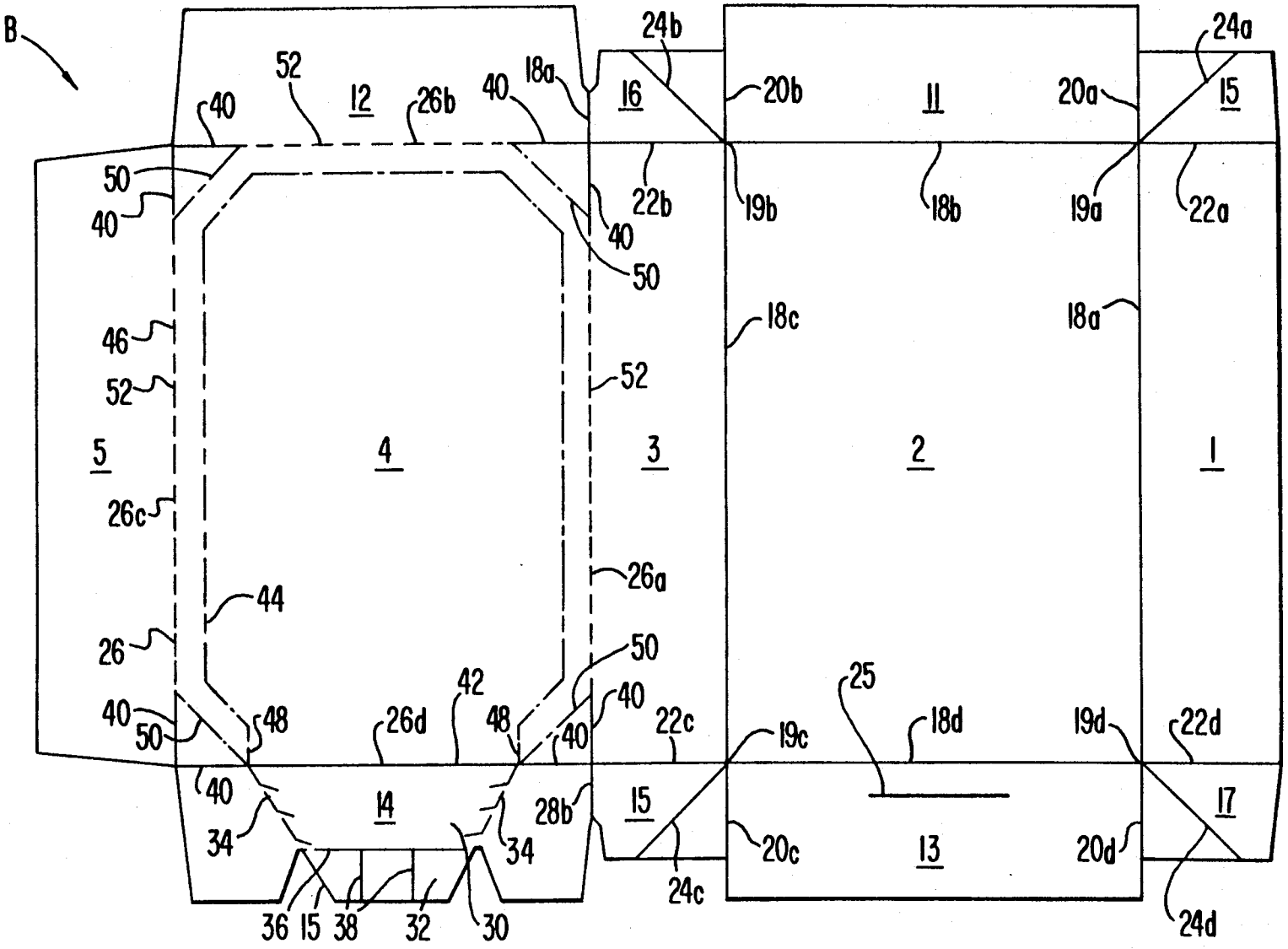
FIG. 1 is a top-view of a paperboard carton blank used in forming the carton in accordance with a preferred embodiment of the invention.
Figure 2:
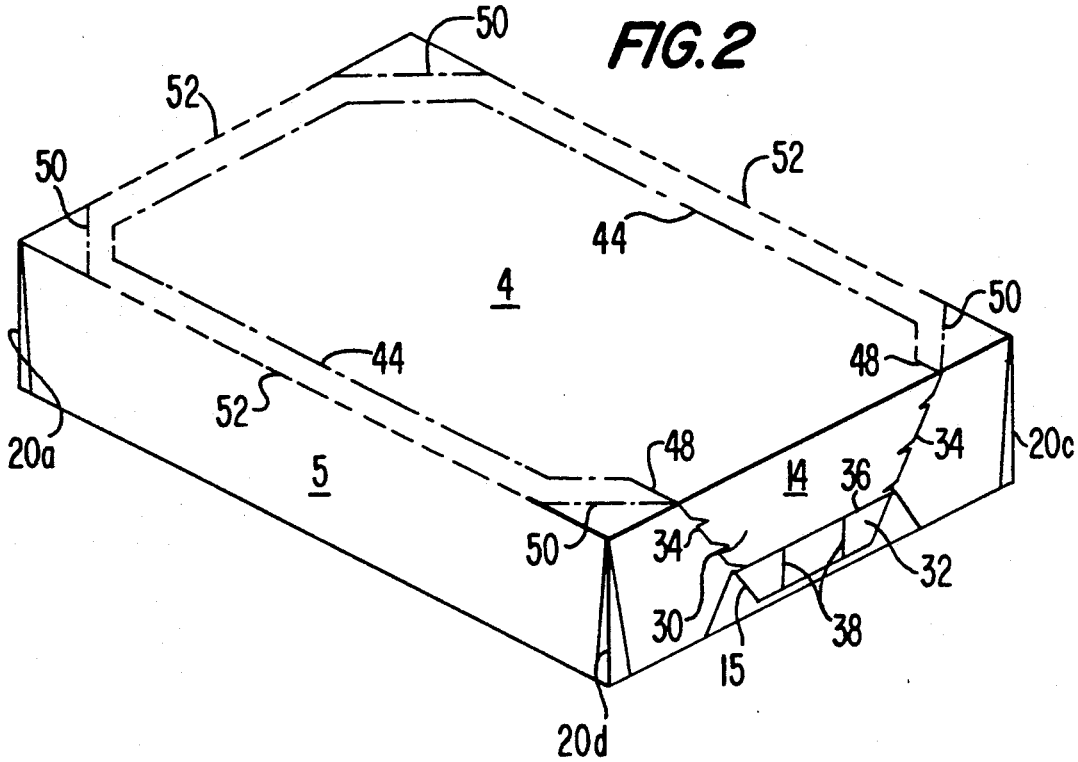
FIG. 2 is a perspective view of the paperboard carton in accordance with a preferred embodiment of the invention with the carton in its closed and sealed condition.
Figure 3:
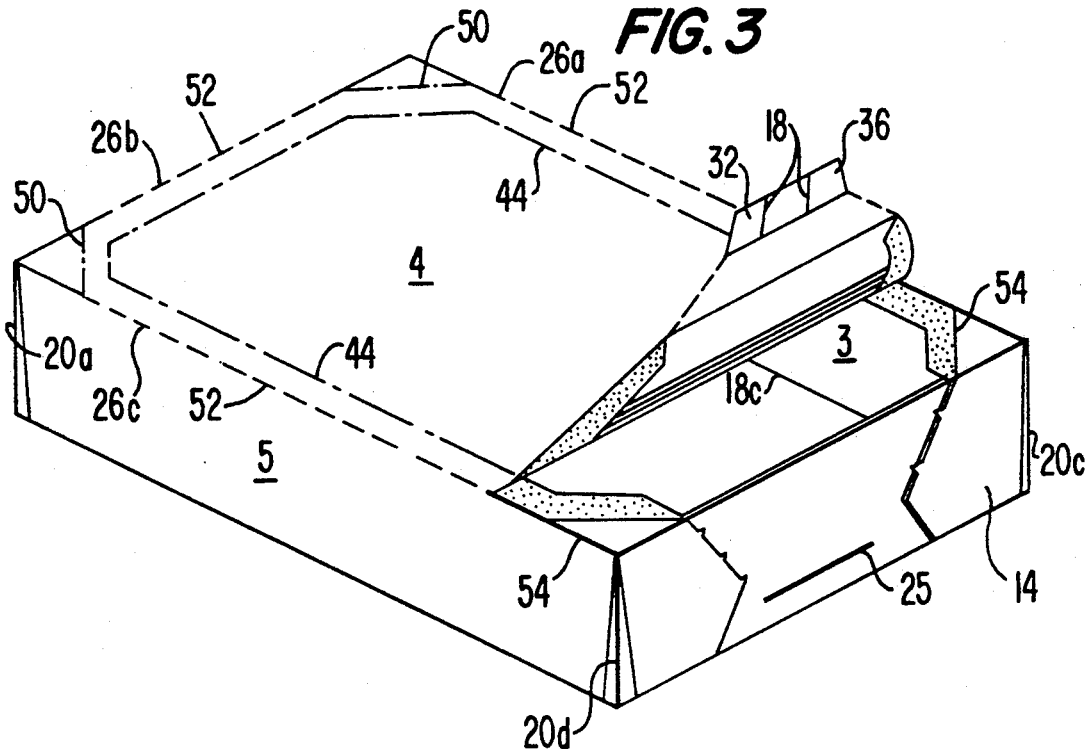
FIG. 3 is a perspective view of the carton of FIG. 2 in its partially opened condition.
Figure 4:
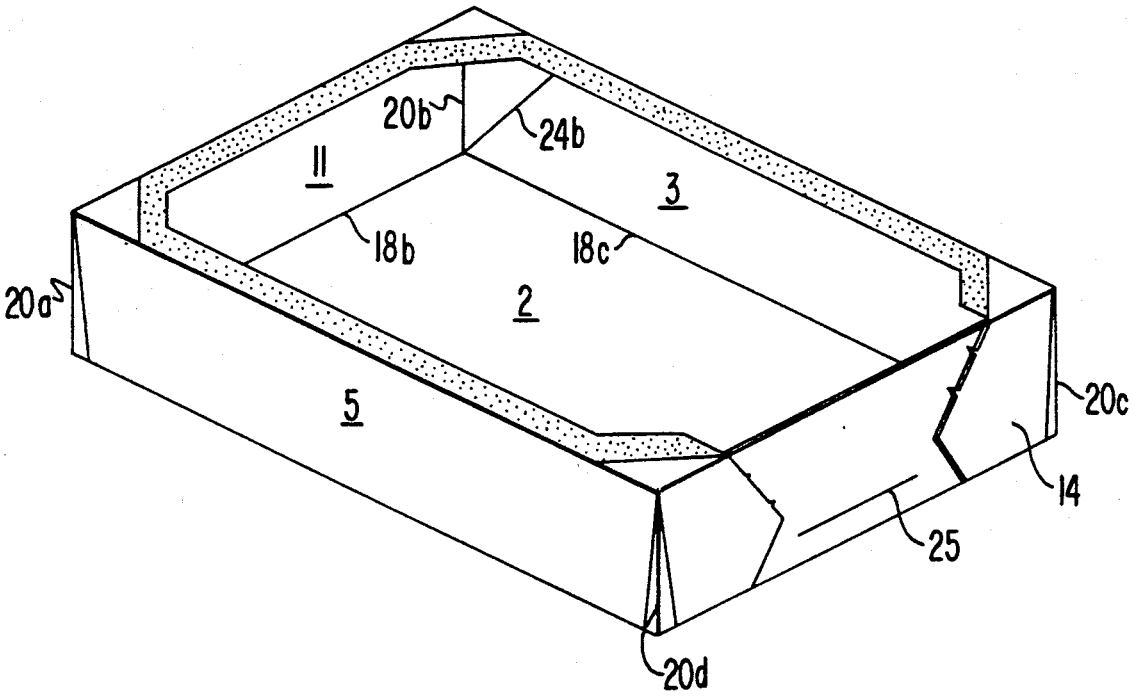
FIG. 4 is a perspective view of the carton of FIGS. 2 and 3 in its fully open condition with a significant portion of the top panel removed therefrom.

Referring now to FIG. 1, there is shown a carton blank for forming the carton set forth in FIGS. 2 through 4. Carton blank B set forth in FIG. 1 comprises a side panel 1, a bottom panel 2, and side panels 3–5. The bottom panel 2 is flanked on either side by sidewalls 11 and 13 while the top panel 4 is flanked on either side by end panel 12 and front panel 14 with front panel 14 also including a lift tab 15. This feature will be described in greater detail hereinbelow.

The bottom structure of the carton includes the bottom panel 2 defined by fold lines 18*a*, 18*b*, 18*c* and 18*d*. Side panels 1 and 3 extend from fold lines 18*a* and 18*b*, respectively, while sidewalls 11 and 13 extend from fold lines 18*b* and 18*d*, respectively. In addition thereto, web corners 15, 16, 17 and 18 extend between the respective adjacent side panels and sidewalls at the corners 19*a* through 19*d* of the bottom panel 2. Prescored fold line 20*a* through 20*d* and 22*a* through 22*d* extend between respective web corners and their adjacent panels. Each of the web corners 15 through 18 include a substantially diagonally extending crease scored fold line 24*a* through 24*d* which when the carton is erected forms a box-like food containing configuration by heat sealing the now diagonally folded web corner against a respective one of the adjacent panels. This being best illustrated in FIG. 4.

The sidewall 13 includes an embossed line 25 formed therein, the significance of which will be set forth in greater detail hereinbelow.

Prior to the description of the construction of the top panel 4 and front panel 14, it should be noted that while the opening feature is illustrated as opening in what may be termed as a side to side relationship, the opening feature may be formed such that the lift tab 15 is integrally formed in the side panel 5 thereby resulting in an opening of the top panel in what may be referred to as a front to back relationship. The particular arrangement may be dictated by the contents being contained therein and the orientation of any printed matter on the carton.

Referring again to FIG. 1, as set forth above the top panel 4 includes the side panel 3 extending from a peripheral edge 26*a* thereof and the overlying side panel 5 extending from a peripheral edge 26*c* thereof. End panel 12 extends from top panel 4 along a peripheral edge 26*b* and the overlying front panel 14 extends from the peripheral edge 26*d* of the top panel 4. It should be noted that the web panels 16 and 18 are separated from the end panel 12 and the front panel 14 by through cut score lines 28*a* and 28*b*, respectively.

The front panel 14 includes the lift tab 15 which is integrally formed therein and includes a sealable portion 30 and an initiation portion or pull tab 32. The sealable portion 30 is separated from the remainder of the front panel 14 by way of herringbone cuts 34 such that upon the application of an opening force to the initiation portion or pull tab 32 of the lifting tab 15, the herringbone cuts will break in order to release the lifting tab 15. It should be noted that the lifting tab includes a horizontal crease score 36 and at least one vertical crease score 38, the significance of which will be set forth in greater detail hereinbelow. It should also be noted that while herringbone cuts have been illustrated as separating the lifting tab 15 from the remainder of the front panel 14, any known type of foramination may be used as an alternative.

A portion of the periphery 26 of the top panel 4 includes crease score segments 40 which extend from a respective corner of the top panel 4 to the initiation of the respective line of weakness. An additional crease score line 42 is provided along the peripheral edge 26*d*.

The opening feature of the present invention includes a continuous inner partially cut score line of weakness 44 formed in an inner surface of the top panel 4 and which is spaced inwardly from and continues about the periphery of the top panel 4. The inner line of weakness being cut 5–85% and preferably approximately 50% of the way through the paperboard material. The inner partially cut score line of weakness 44 extends substantially parallel to an outer line of weakness 46 about the entire periphery of the top panel except for the regions 48 where the partially cut score line of weakness 44 extends away from the respective herringbone cuts 34 and substantially perpendicular to the peripheral edge 26*d* of the top panel 4. The particular length of the section 48 is determined in accordance with the particular dimensions of the top panel 4 and is arranged such that a proper ply separation occurs between the inner partially cut score line of weakness 44 and the line of weakness 46.

The line of weakness 46 is broken into two distinct types of lines of weakness. The diagonal sections 50 are partially cut score lines of weakness formed in an outer surface of the top panel 4 and extends through 5–85% and preferably approximately 50% of the paperboard thickness. The portions 52 of the lines of weakness are perforated cut score lines of weakness and intermittently extend through the entire thickness of the paperboard material. While the perforated lines of weakness 52 extend through the entire thickness of the paperboard material, when the paperboard carton is formed from a blank in accordance with the present invention, due to the compression of the paperboard material along an inner region of the crease score lines 40 and perforated cut score lines 52 when the blank is folded, the through cuts are essentially compressed and closed off at their inner end in order to maintain the interior of the carton substantially impervious to moisture.

Referring now to FIGS. 2 through 4, and particularly FIG. 2, the carton is erected by inwardly folding each of the web panels 15 through 18 towards the center of the bottom panel 2 which forces sidewalls 11 and 13 and side panels 1 and 3 into an erect position substantially perpendicular to the bottom panel 2. Once in this condition the web panels 15 through 18 are heat sealed to an inside surface of one of the side panels or sidewalls. It should be noted while these web panels are preferably heat sealed in place due to the overcoating on the paperboard material; however, any conventional adhesive or hot melt type sealing may be carried out.

With the side panels 1 and 3 and sidewalls 11 and 13 in their erect condition, thereby forming a reservoir for contents, contents are placed therein and the top panel 4 is overfolded along line 26*a* to cover the contents of the carton. Once in this position, side panel 5, end panel 12 and front panel 14 are folded downwardly to overly their respective underlying panels and heat sealed thereto. This construction being illustrated in FIG. 2.

When overfolding the front panel 14 onto the outer surface of the sidewall 13, the crease score fold lines of the lifting tab 31 will overlie the embossed line 25 formed in the sidewall 13. In doing so, the portion 32 of the lifting tab 31 will be positioned away from the surface of the sidewall 13 which will facilitate access to the pull tab portion 32 lift tab 31 by the consumer by making it easy to grasp the pull tab 32 of the lift tab 31 and fold such portion back along the crease score fold line 36. By providing the crease score lines 38 in this case a pair of substantially parallel crease score lines 38, in conjunction with the embossed line 25, the pull tab portion 32 of the lift tab 31 will be refrained from adhering to the outside surface of the end panel 13. This occurs because the crease score lines 38 extend from an inner surface of the pull tab 32 and contact a raise surface of the embossed line 25 which extends from an outer surface of the sidewall 13. Consequently, there is minimal contact between the inner surface of the pull tab 32 and the outer surface of the sidewall 13.

When it is desired to gain access to the contents of the carton, the consumer merely grasps the portion 32 of the lift tab 31, which as previously mentioned is facilitated by the cooperation between the crease score lines 38 and the embossed line 25, and folds back such portion along the crease score fold line 36. Once in this position the portion 32 may be easily grasped by the consumer and an opening force, i.e. an outward and upward force may be applied which causes the front panel 14 to tear along the herringbone cuts 34. At the termination of the herringbone cuts, a ply-separation between the inner partially cut score line of weakness 48 and the outer partially cut score line of weakness 50 at the point where these two lines substantially intersect is initiated. This ply-separation continues diagonally outward through the region 54 and subsequently substantially parallel to the peripheral edges 26*a* and 26*c* of the top panel 4. This ply-separation continues to occur between the inner partially cut score lines of weakness 44 and the outer perforated through cut lines of weakness 52 until their termination at which point the ply-separation continues diagonally inward toward the peripheral edge 26*b* of top panel 4. The diagonal ply-separation is carried out between the partially cut score lines of weakness 44 and the partially cut score lines of weakness 50. Once this position has been reached, the top panel 4 may be readily removed by continuing the ply-separation between the inner partially cut score line of weakness 44 and the perforated through cut score line of weakness 52 along the peripheral edge 26*b* of the top panel 4. However, it should be noted that if the contents of the carton are to be heated in a known manner in a microwave oven, the top panel 4 may remain intact along the peripheral edge 26*b* and subsequently folded down over the contents with the lift tab 15 being inserted into the carton thereby holding the top panel 4 in place. This is carried out so as to maintain moisture within the container during cooking and to prevent the contents of the carton from being dispersed out of the reservoir of the carton. Once the contents have been cooked as desired by the consumer, the top panel 4 may be readily removed by continuing the ply-separation along the peripheral edge 26*b* of the top panel 4.

It should be noted that the diagonal ply-separation between the peripheral edges 26*a* and 26*b* and the peripheral edges 26*c* and 26*b* need not be present. The ply-separation along the peripheral edges 26*a* and 26*c* may extend to the peripheral edge 26*b* with either a continued ply-separation being carried out along the peripheral edge 26*b* or the peripheral edge 26*b* may be merely a single crease score line thereby providing a hinge for top panel 4.

While the present invention has been described with reference to a preferred embodiment, it will be appreciated by those skilled in the art that the invention may be practiced otherwise than as specifically described herein without departing from the spirit and scope of the invention. It is, therefore, to be understood that the spirit and scope of the invention be limited only by the appended claims.

INDUSTRIAL APPLICABILITY

The above described opening feature may be incorporated in any paperboard type carton wherein it is desired to provide a mechanism for gaining easy access to the contents of the carton while maintaining the structural integrity of the carton. Moreover, such an opening feature may be provided in paperboard cartons of the above-mentioned type wherein it is desired to facilitate the consumers access to the lifting tab.

What is claimed is:

1. A carton blank formed of a paperboard material for forming a paperboard carton, said blank comprising:

a first panel having side walls connected thereto by scored fold lines formed between a respective one of said side walls and a respective edge of said first panel;

a second panel having side walls connected thereto by scored fold lines formed between a respective side wall and an edge of said second panel, one of said side walls of said first panel one of said side walls of said second panel being congruent; and an opening means formed in said second panel for permitting access to an interior of a carton formed from the blank, said opening means comprising:

an opening force receiving means integrally formed in one of said side walls of said second panel for providing an initiation of said opening means;

initial regions of weakness formed in said second panel extending from said opening force receiving means to respective peripheral edges of said second panel; and continued regions of weakness extending from said initial regions of weakness substantially parallel to and including respective peripheral edges of said second panel to an edge of said second panel opposing said opening force receiving means;

wherein said continued regions of weakness include an inner partially cut score line of weakness and an outer perforated through cut line of weakness with said inner and outer lines of weakness extending substantially parallel to one another.

2. The blank as defined in claim 1, wherein said initial regions of weakness include inner and outer partially cut lines of weakness extending substantially parallel to one another.

3. The blank as defined in claim 2, wherein said opening force receiving means includes foraminations extending from a free edge of said one of said side walls of said second panel to a respective peripheral edge of said second panel, said respective peripheral edge, said free edge and said foraminations defining a lifting tab.

4. The carton as defined in claim 3, wherein respective lines of weakness forming said initial regions of weakness converge towards one another and intersect at said respective peripheral edge of said second panel adjacent said one of said side walls.

5. The carton as defined in claim 4, wherein the point of intersection of said lines of weakness is adjacent the termination of a respective foramination.

6. The blank as defined in claim 3, further comprising means for facilitating the manipulation of said lifting tab.

7. The blank as defined in claim 6, wherein said means for facilitating the manipulation of said lifting tab includes at least one crease score line formed in a surface of said lifting tab.

8. The blank as defined in claim 7, further comprising an embossed line formed in a predetermined side wall of said first panel, said predetermined side wall being that side wall which underlies said lifting tab in the carton formed from the blank.

9. The blank as defined in claim 5, wherein said embossed line underlies said crease score line formed in said lifting tab.

10. The blank as defined in claim 9, wherein said crease score line formed in said lifting tab extends outwardly from an inner surface of said lifting tab and said embossed line extends outwardly from an outer surface of said predetermined side wall such that a portion of said crease score line contacts said embossed line thereby preventing the sealing of a portion of said lifting tab to said predetermined side wall.

11. The blank as defined in claim 10, wherein said lifting tab includes an intermediate crease score fold line extending substantially parallel to said respective peripheral edge and between said foraminations.

12. The blank as defined in claim 11, wherein there are two crease score lines formed in said lifting tab extending substantially parallel to one another between said free edge of said side wall of said second panel and said crease score fold line.

13. A method of forming a region of weakness in a paperboard blank comprising;

forming a first line of weakness in a first surface of the paperboard material; and forming a second line of weakness in an opposing surface of the paperboard material substantially perpendicular to and offset from said first line of weakness defining a region of weakness therebetween;

wherein at least one of said lines of weakness is a perforated through cut line of weakness.

14. The method as defined in claim 13, further comprising the step of forming the paperboard blank into a carton, wherein the region of weakness forms an opening means in a panel of the carton for gaining access to an interior of the carton.

15. The method as defined in claim 14, further comprising the step of forming a pair of regions of weakness in said panel of the carton, wherein said pair of regions of weakness form said opening means.

16. A carton for containing a product placed therein, said carton comprising:

a bottom panel;

a top panel;

side walls extending substantially perpendicularly away from said bottom panel toward said top panel, said side walls being connected to said bottom panel about a periphery thereof;

overlapping side walls extending substantially perpendicularly away from said top panel toward said bottom panel from predetermined peripheral edges of said top panel; and an opening means formed in said top panel for permitting access to an interior of the carton, said opening means comprising:

an opening force receiving means integrally formed in one of said overlapping side walls of said top panel for providing an initiation of said opening means;

initial regions of weakness formed in said top panel extending from said opening force receiving means to respective peripheral edges of said top panel; and continued regions of weakness extending from said initial regions of weakness substantially parallel to and including said respective peripheral edges of said top panel toward a peripheral edge of said top panel opposing said opening force receiving means;

wherein said continued regions of weakness include a partially cut score line of weakness formed in an inner surface of said top panel and a perforated through cut line of weakness formed in said top panel with said lines of weakness extending substantially parallel to one another.

17. The carton as defined in claim 16, wherein said initial regions of weakness include inner and outer partially cut lines of weakness extending substantially parallel to one another.

18. The blank as defined in claim 16, wherein said opening force receiving means includes foraminations extending from a free edge of said one of said overlapping side walls of said top panel to a respective peripheral edge of said top panel, said respective peripheral edge, said free edge and said foraminations defining a lifting tab.

19. The carton as defined in claim 18, wherein respective lines of weakness forming said regions of weakness converge towards one another and intersect at said peripheral edge of said top panel adjacent said one of said overlapping panels.

20. The carton as defined in claim 19, wherein the point of intersection of said lines of weakness is adjacent the termination of a respective foramination.

21. The carton as defined in claim 18, further comprising means for facilitating the manipulation of said lifting tab.

22. The carton as defined in claim 21, wherein said means for facilitating the manipulation of said lifting tab includes at least one crease score line formed in a surface of said lifting tab.

23. The carton as defined in claim 21, further comprising an embossed line formed in a predetermined side wall of said bottom panel, said predetermined side wall being that side wall which underlies said lifting tab in the carton formed from the blank.

24. The carton as defined in claim 23, wherein said embossed line underlies said crease score line formed in said lifting tab.

25. The carton as defined in claim 24, wherein said crease score line formed in said lifting tab extends outwardly from an inner surface of said lifting tab and said embossed line extends outwardly from an outer surface of said predetermined side wall such that a portion of said crease score line contacts said embossed line thereby preventing the sealing of a portion of said lifting tab to said predetermined side wall.

26. The carton as defined in claim 25, wherein said lifting tab includes an intermediate crease score fold line extending substantially parallel to said respective peripheral edge and between said foraminations.

27. The carton as defined in claim 26, wherein there are two crease score lines formed in said lifting tab extending substantially parallel to one another between said free edge of said side wall of said top panel and said crease score fold line.

28. A device for facilitating the manipulation of a lifting tab of a paperboard carton comprising:

at least one crease score line formed in a surface of the lifting tab; and an embossed line formed in a surface of an underlying panel, said embossed line positioned so as to underlie at least a portion of said crease score line such that a portion of said embossed line contacts said portion of said crease score line thereby preventing the sealing of a portion of the lifting tab to the underlying panel.

29. The device as defined in claim 28, wherein said crease score line extends outwardly from an inner surface of the lifting tab and said embossed line extends outwardly from an outer surface of the underlying panel.

30. The device as defined in claim 29, wherein the lifting tab includes an intermediate crease score fold line extending substantially parallel a free edge of lifting tab and between foraminations forming the lifting tab.

31. The device as defined in claim 26, wherein there are two crease score lines formed in the lifting tab extending substantially parallel to one another between the free edge of the lifting tab and said crease score fold line.

* * * * *